US010916883B2

(12) United States Patent
Yamada

(10) Patent No.: US 10,916,883 B2
(45) Date of Patent: Feb. 9, 2021

(54) CONNECTOR FITTING BODY

(71) Applicant: Sumitomo Wiring Systems, Ltd., Mie (JP)

(72) Inventor: Hiroki Yamada, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/708,723

(22) Filed: Dec. 10, 2019

(65) Prior Publication Data

US 2020/0194930 A1 Jun. 18, 2020

(30) Foreign Application Priority Data

Dec. 17, 2018 (JP) ..... 2018-235049

(51) Int. Cl.
*H01R 13/621* (2006.01)
*H01R 13/52* (2006.01)
*H01R 13/405* (2006.01)

(52) U.S. Cl.
CPC ..... *H01R 13/6215* (2013.01); *H01R 13/405* (2013.01); *H01R 13/5202* (2013.01)

(58) Field of Classification Search
CPC ..... H01R 13/405; H01R 13/5202; H01R 13/6215
See application file for complete search history.

(56) References Cited

U.S. PATENT DOCUMENTS 6,257,918 B1 * 7/2001 Yamamoto ..... H01R 13/6315 439/34
8,622,674 B2 * 1/2014 Shibata ..... H01R 13/6215 411/366.1
2010/0143074 A1 * 6/2010 Sumiya ..... F02F 7/006 411/411

FOREIGN PATENT DOCUMENTS

JP 2013-122900 6/2013

* cited by examiner

*Primary Examiner* — Briggitte R. Hammond
(74) *Attorney, Agent, or Firm* — Gerald E. Hespos; Michael J. Porco; Matthew T. Hespos

(57) ABSTRACT

A connector fitting body (1) is formed by tightening a bolt (4) arranged in a collar (6) of a first housing (2) into a nut (5) of a second housing (3). The bolt (4) includes a head (41) to contact an end surface of the collar (6) and a shaft. A base portion (42) of the shaft is linked coaxially to a tip side of the head (41), and a tip portion (43) of the shaft is linked coaxially to the base portion (42) of the shaft. An inner peripheral surface of the collar (6) has a base end inner peripheral surface (61) with the base portion (42) of the shaft arranged thereon and a tip inner peripheral surface (62) having a smaller inner diameter than the base end inner peripheral surface (61) and having the tip portion (43) of the shaft arranged thereon.

6 Claims, 7 Drawing Sheets

CONNECTOR FITTING BODY

BACKGROUND

Field of the Invention

The invention relates to a connector fitting body in which a first housing and a second housing holding terminals are fit using a bolt.

Related Art

A relay connector and an electric wire are used for connecting electronic control equipment to a control device. The relay connector is used as a connector fitting body and has a male connector and a female connector fit therein. The male connector includes male terminals, and the female connector includes female terminals to be conductive respectively with the male terminals. The male and female connectors generally are fit directly by a worker. However, consideration has been given to a lever-type fitting structure that utilizes the principle of leverage, and a tight-fitting structure utilizing a tightening force of a bolt to facilitate fitting by the worker.

Japanese Unexamined Patent Publication No. 2013-122900 discloses a connector fitting body having a tight-fitting structure. More particularly, the connector of Japanese Unexamined Patent Publication No. 2013-122900 has a first housing fit to a second housing by tightening a bolt inserted through a through hole of a hollow cylindrical mounting tube of the first housing into a nut provided in the second housing.

The nut and the bolt in the connector of Japanese Unexamined Patent Publication No. 2013-122900 are made of metal, whereas the first housing and the second housing are made of resin in most cases. A head of the bolt and the nut directly face each other, and a fit state of the first housing and the second housing is maintained by the joining of metal members, i.e. the bolt and the nut.

However, the bolt is inserted into the mounting tube of the first housing that is formed by injection molding. Thus, it is difficult to set dimensional tolerances of the bolt and the mounting tube and the bolt tends to be inclined with respect to the first housing when the bolt is tightened into the nut.

The invention was developed on the basis of the above situation and aims to provide a connector fitting body capable of making a bolt less likely to incline with respect to a collar and a first housing.

SUMMARY

One aspect of the invention relates to a connector fitting body with a first housing and a second housing to be held in the first housing. First terminals are held in the first housing, and second terminals are held in the second housing. The first and second terminals become conductive with one another when the first and second housings are connected. A collar made of metal is arranged in a first insertion hole of the first housing, and a nut made of metal is arranged in a second insertion hole of the second housing. A bolt made of metal also is provided and has a head and a shaft. The shaft has a base portion adjacent the head and a tip portion opposite the base end. The head is held in contact with a base end surface of the collar. The base portion of the shaft is linked coaxially to a side of the head facing the tip. Additionally, the base end of the shaft has a smaller outer diameter than the head and is arranged on an inner peripheral side of the collar. The tip portion of the shaft is linked coaxially to a tip of the base portion of the shaft, has a smaller outer diameter than the base portion of the shaft, and is arranged partially on the inner peripheral side of the collar. The tip portion of the shaft is formed with an external thread to be engaged threadedly with an internal thread of the nut. An inner peripheral surface of the collar is formed with a base end inner peripheral surface having the base end portion of the shaft arranged thereon and a tip inner peripheral surface having a smaller inner diameter than the base end inner peripheral surface and having the tip portion of the shaft arranged thereon.

The metal collar is sandwiched between the head of the bolt and the nut so that the first and second housings are not compressed more than necessary. Further, the collar is shaped to make the bolt less likely to incline with respect to the collar and the first housing.

More specifically, the metal bolt is formed with the head, the base portion of the shaft and the tip portion of the shaft. The outer diameter of the base portion of the shaft is smaller than that of the head, and the outer diameter of the tip portion of the shaft is smaller than that of the base portion of the shaft. The base portion of the shaft of the bolt is arranged on the base end inner peripheral surface of the collar, and the tip portion of the shaft of the bolt is arranged on the tip inner peripheral surface of the collar. That is, the inner peripheral shape of the collar is changed in two steps in conformity with the outer peripheral shape of the bolt whose outer diameter is changed in two steps.

The posture of the bolt with respect to the collar and the first housing is supported by the base end inner peripheral surface of the collar and also by the tip inner peripheral surface of the collar. More particularly, the tip inner peripheral surface of the collar supports the tip portion of the shaft formed with the external thread. Thus, a position where the collar supports the bolt in the first housing is maximally close to the second housing having the nut arranged therein. In this way, the bolt is less likely to incline with respect to the collar and the first housing, and the first housing and the second housing can be fit more easily by tightening the bolt into the nut.

The bolt is on the inner peripheral surface of the metal collar. Thus, dimensional tolerances of the collar and at least one of the base portion and the tip portion of the shaft portion can be adjusted by adjusting the inner diameter of at least one of the base end inner peripheral surface and the tip inner peripheral surface of the metal collar. Thus, dimensional tolerances of the bolt and the collar can be set easily, and the bolt is less likely to incline.

DETAILED DESCRIPTION

Figure 1:
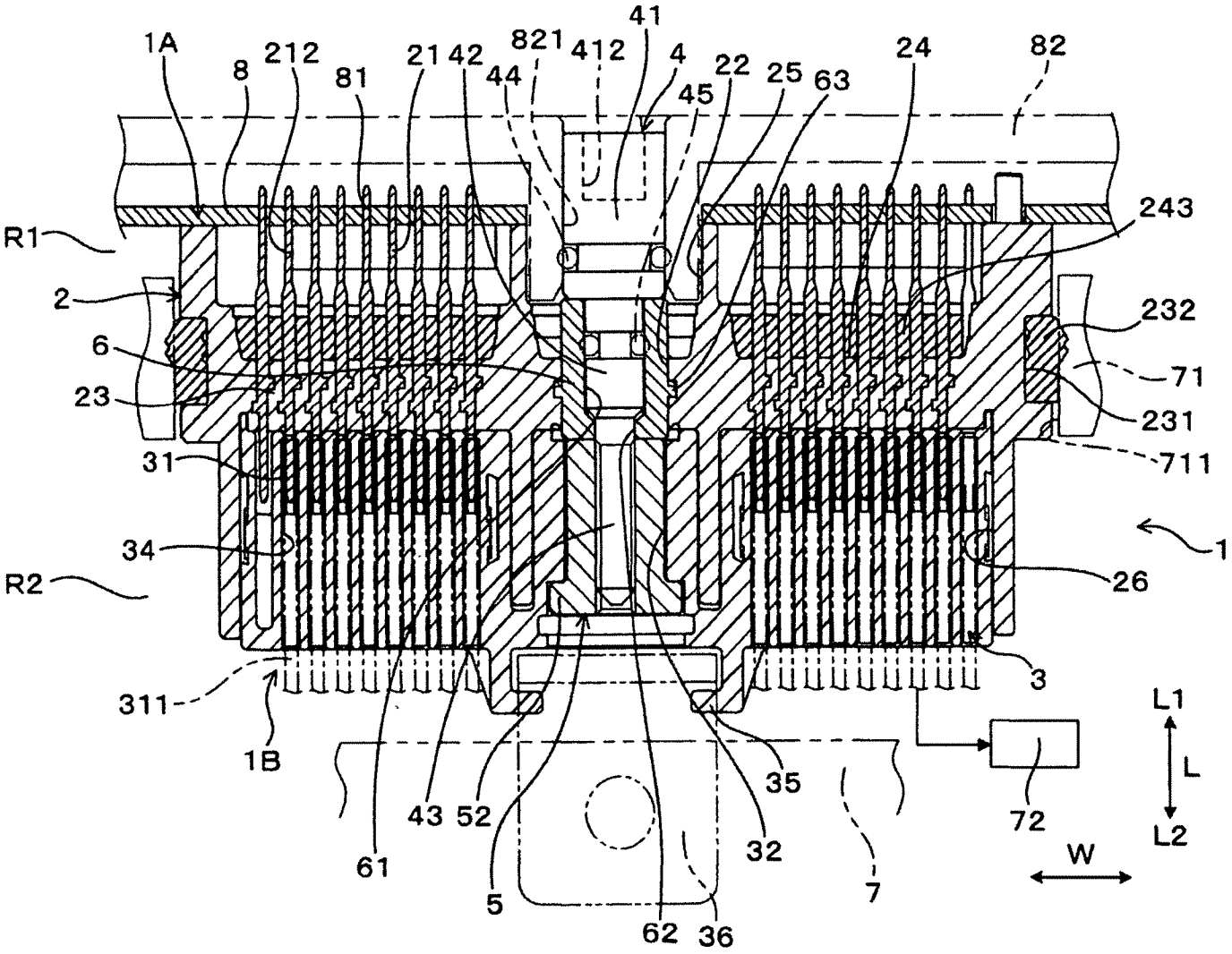
FIG. 1 is a front view in section of a connector fitting body according to an embodiment.

A preferred embodiment of the connector fitting body is described with reference to the drawings. A connector fitting body 1 of this embodiment includes a first housing 2, a second housing 3, a collar 6, a nut 5 and a bolt 4, as shown in FIG. 1. The first housing 2 is made of resin and holds first terminals 21. The second housing 3 is made of resin and is fit to the first housing 2. The second housing 3 holds second terminals 31 that respectively contact the first terminals 21 to be conductive with the first terminals 21.

Figure 2:
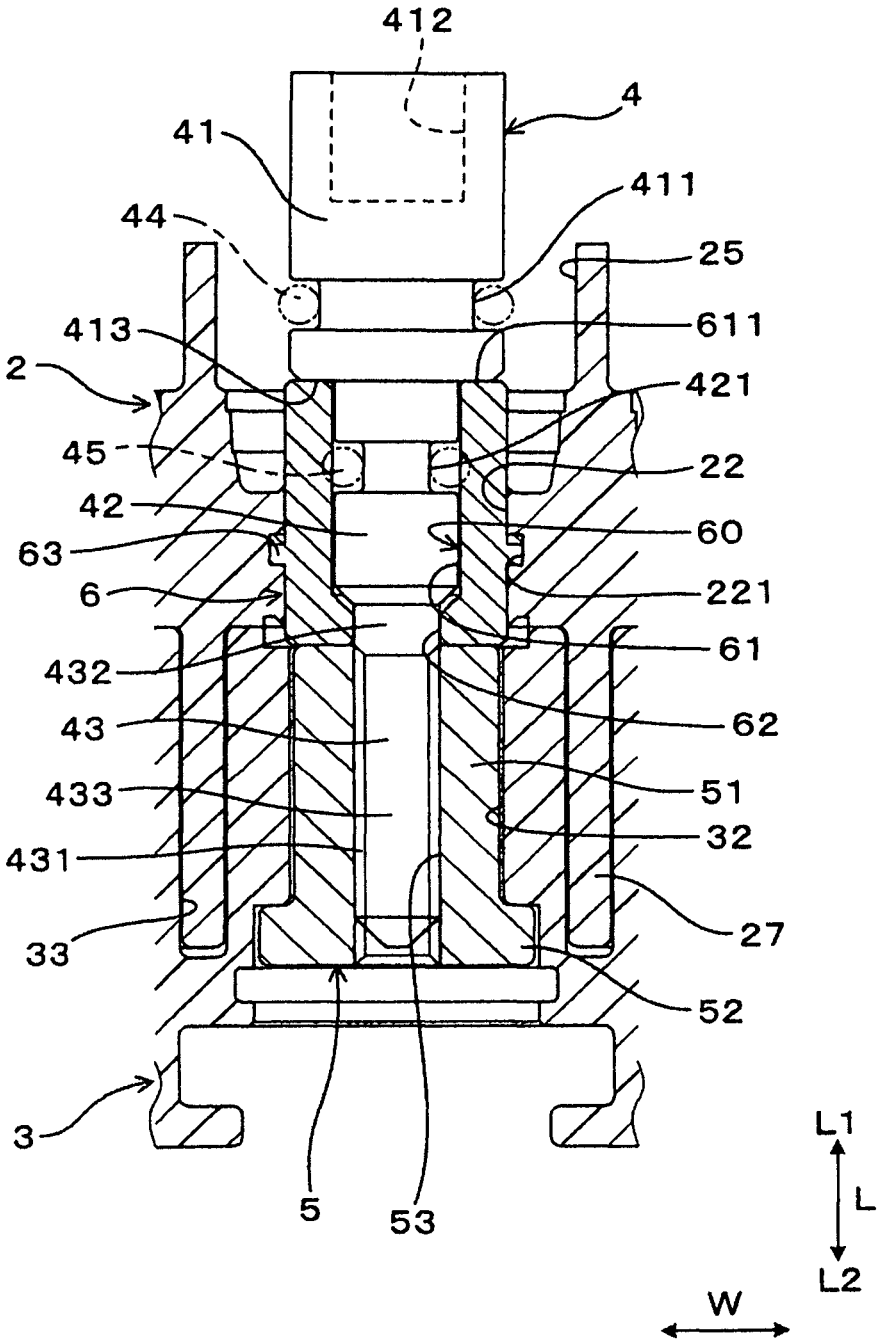
FIG. 2 is a section enlargedly showing a part of FIG. 1 according to the embodiment.

The collar 6 is made of metal and is arranged in a first insertion hole 22 of the first housing 2, as shown in FIG. 2. The nut 5 is made of metal and is arranged in a second insertion hole 32 of the second housing 3. The bolt 4 is made of metal and includes a head 41 to be held in contact with a base end surface 611 of the collar 6. The bolt 4 also has a shaft with a base portion 42 linked coaxially to a tip side of the head 41, and a tip portion 43 linked coaxially to a tip side of the base portion 42 of the shaft. The base portion 42 of the shaft has a smaller outer diameter than the head 41 and is arranged on an inner peripheral side of the collar 6. The tip portion 43 of the shaft has a smaller outer diameter than the base portion 42, is arranged partially on the inner peripheral side of the collar 6 and includes an external thread 431 to be engaged threadedly with an internal thread 53 of the nut 5. The inner peripheral surface of the collar 6 is formed with a base portion inner peripheral surface 61, on which the base portion 42 of the shaft is arranged, and a tip portion peripheral surface 62 that has a smaller inner diameter than the base portion inner peripheral surface 61 and on which the tip portion 43 of the shaft is arranged.

(Connector Fitting Body 1 and Arrangement Environment Thereof)

As shown in FIG. 1, the connector fitting body 1 is used as a relay connector for relaying an electric wiring for electrically wiring various electronic control equipment 72 to a control device (control board 8). The control board 8 is formed with a control circuit for controlling various electronic control equipment 72. The connector fitting body 1 is formed by fitting a first connector 1A constituted by the first terminals 21 and the first housing 2 and a second connector 1B constituted by the second terminals 31 and the second housing 3.

The electronic control equipment 72 can be mounted in various machine components 7. A machine component 7 of this embodiment is an automatic transmission mounted in an automotive vehicle, and the electronic control equipment 72 includes a spool valve of a valve body, actuators, such as a motor, and sensors such as a resolver used in the automatic transmission. The electronic control equipment 72 is connected electrically to the control board 8 constituting an electronic control unit (ECU) via the first terminals 21 and second terminals 31 of the connector fitting body 1. The control board 8 is covered by a cover 82. Note that the machine component 7 may be one of various machine components other than the automatic transmission.

As shown in FIG. 1, oil (automatic transmission oil) is used to perform an automatic shift control operation and to lubricate constituent components. The connector fitting body 1 is arranged in a case hole 711 in a case 71 of the automatic transmission. The case 71 is engaged with the cover 82 and the control board 8 is in a space enclosed by the case 71 and the cover 82.

An outer peripheral sealing member 232 is mounted on the outer periphery of the first housing 2 of the connector fitting body 1 for holding oil in contact with the inner periphery of the case hole 711. The outer peripheral sealing member 232 is arranged in an outer peripheral groove 231 formed in the outer periphery of the first housing 2. The outer peripheral sealing member 232 prevents oil in the case 71 from leaking to the outside of the case 71 through a clearance between the connector fitting body 1 and the case hole 711.

When the connector fitting body 1 is arranged in the case hole 711, the second terminals 31 held in the second housing 3 are exposed under an oil environment R2 in which the second terminals 31 held in the second housing 3 can contact the oil. Further, the first terminals 21 held in the first housing 2 are exposed under an air environment R1 to define a space in which the control board 8 is arranged exposed to air.

As shown in FIGS. 1 to 7, the bolt 4 extends in an axial direction L in the connector fitting body 1. Further, a direction along long sides of the connector fitting body 1 in a plane perpendicular to the axial direction L is referred to as a width direction W, and a direction along short sides of the connector fitting body 1 in the plane perpendicular to the axial direction L is referred to as a thickness direction B. An end of the connector fitting body 1 where the first connector 1A is located is referred to as a base end L1 and an end where the second connector 1B is located is referred to as a tip end L2. The base end L1 is exposed in the air environment R1, and the tip end L2 is exposed in the oil environment R2.

Figure 5:
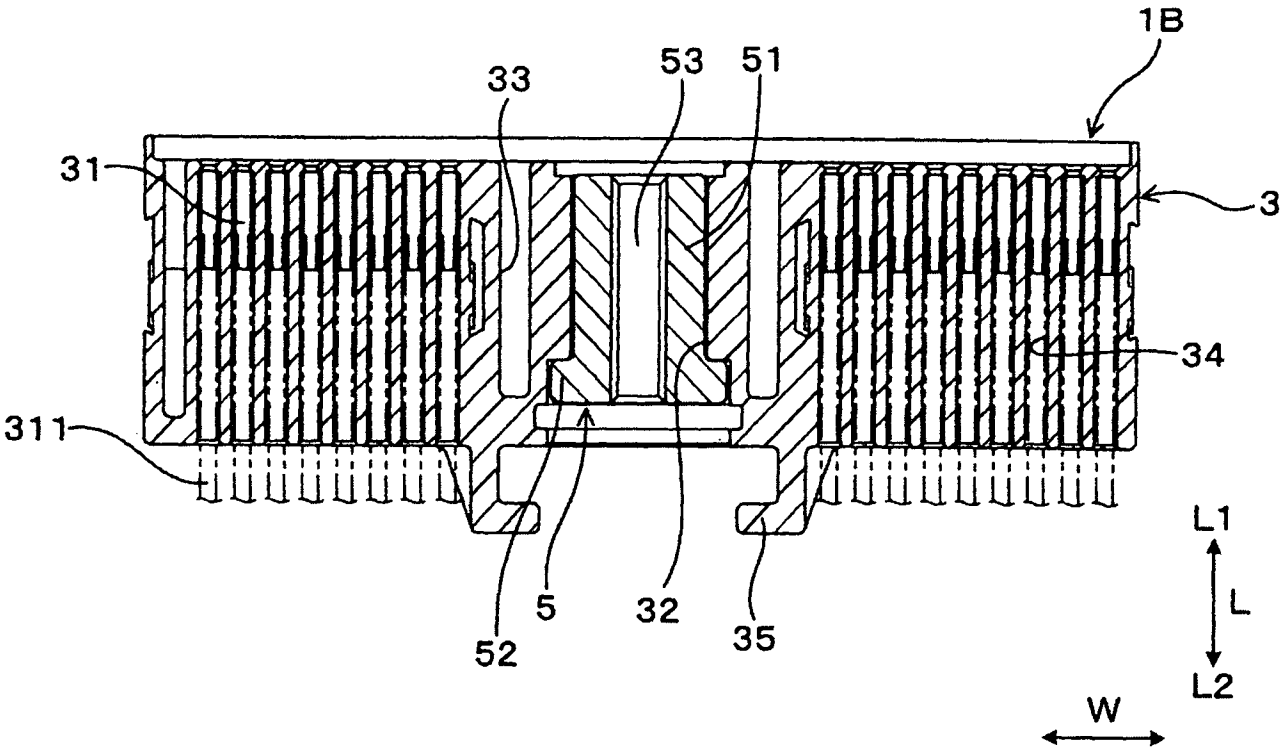
FIG. 5 is a front view in section of a second connector of the connector fitting body according to the embodiment.
Figure 6:
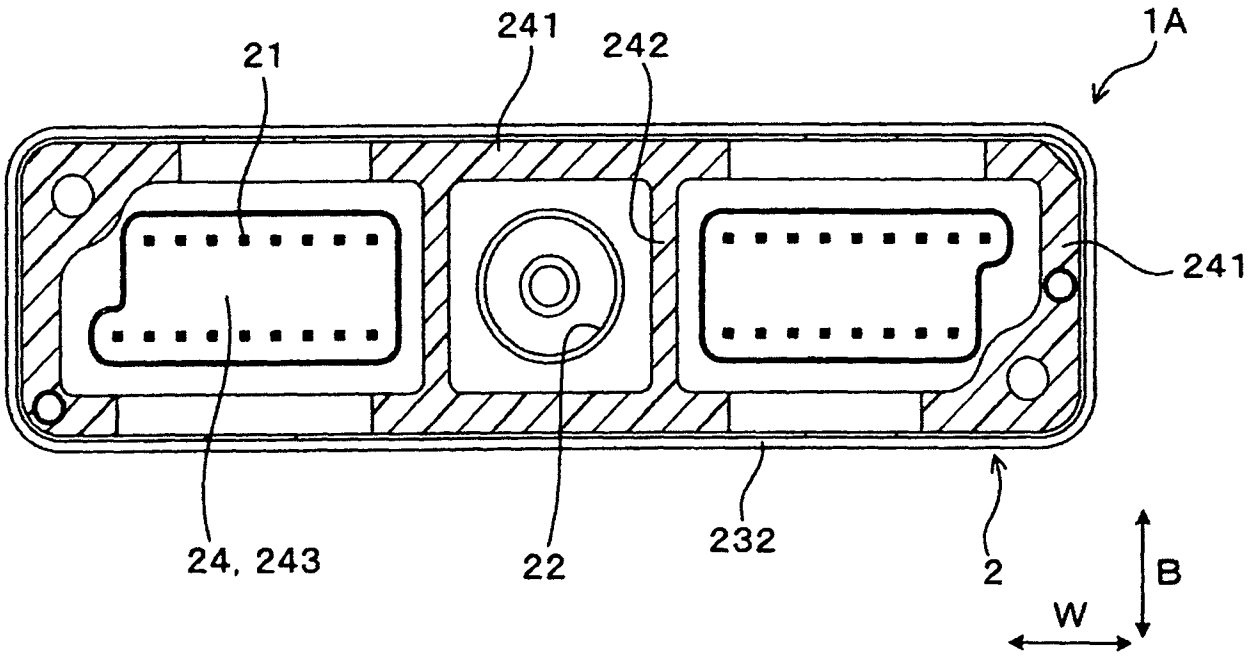
FIG. 6 is a plan view showing the first connector of the connector fitting body according to the embodiment viewed from a base end side.

As shown in FIG. 6, the arrangement positions of the bolt 4, the nut 5, the collar 6 deviate slightly from those of the first terminals 21, the second terminals 31 in the thickness direction B of the connector fitting body. However, to facilitate graphical representation, these arrangement positions are shown in the same cross-section in FIGS. 1, 4, 5 and 7.

(Bolt 4)

Figure 3:
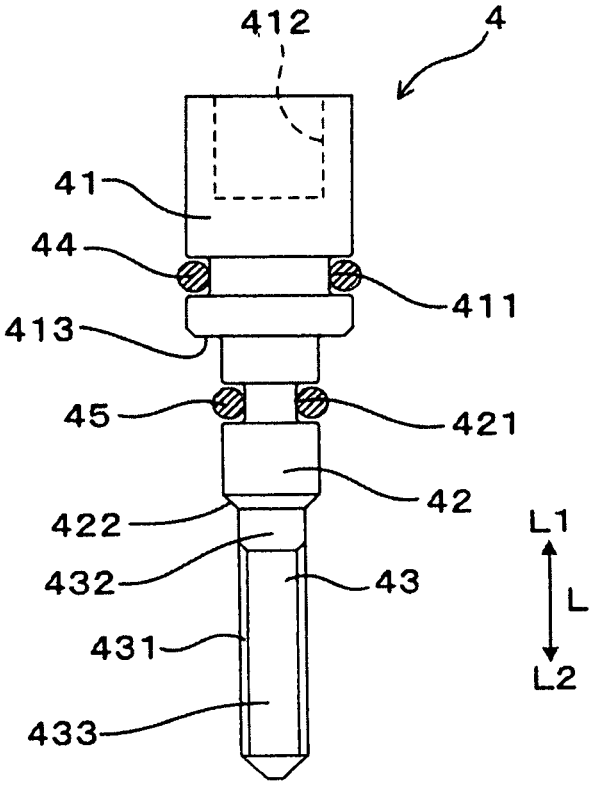
FIG. 3 is a front view of a bolt according to the embodiment.

As shown in FIGS. 2 and 3, the bolt 4 is arranged at a center position of the connector fitting body 1 in the width direction W and the thickness direction B. The bolt 4 is a special bolt with the head 41 having a sealing function. The bolt 4 is made of a metal. The head 41 of the bolt 4 serves as a part for pressing the first housing 2 with respect to the second housing 3 via the collar 6 when an axial force is generated by tightening is.

The head 41, the base portion 42 of the shaft and the tip portion 43 of the shaft have circular cross-sections perpendicular to the axial direction L. An end of the head 41 at the base end L1 has a tool engaging portion 412 to be engaged with a tool for tightening. The tool engaging portion 412 of this embodiment is a hexagonal recess.

Further, as shown in FIGS. 1 to 3, a base end groove 411 is formed in the outer peripheral surface of the head portion 41 of the bolt 4, and a waterproof sealing member 44 is mounted in the base end groove 411 for sealing a clearance between the outer peripheral surface of the head 41 and the inner peripheral surface of a through hole 821 formed in the cover 82 for covering the control board 8. The sealing member 44 is formed by an O-ring made of rubber, but may be one of various packings capable of sealing water besides the O-ring. The sealing member 44 can prevent the intrusion of water through the clearance between the head 41 of the bolt 4 and the through hole 821 and to the control board 8 in the cover 82, even if the cover 82 of the control board 8 is wetted.

A tip end groove 421 is formed in the outer peripheral surface of the base portion 42 of the shaft of the bolt 4, and an oil-proof sealing member 45 is mounted in this tip side groove 421 for sealing a clearance between the outer peripheral surface of the base portion 42 of the shaft and the base end inner peripheral surface 61 of the collar 6. The oil-proof sealing member 45 is an O-ring made of rubber, but may be one of various packings capable of sealing oil besides the O-ring. The oil-proof sealing member 45 prevents oil from penetrating through a clearance between the nut 5 and the second insertion hole 32, into the clearance between the base portion 42 of the shaft and the base end inner peripheral surface 61 of the collar 6.

As shown in FIGS. 2 and 3, the tip portion 43 of the shaft of the bolt 4 includes a base end part 432 formed by a cylindrical surface not formed with the external thread 431, and a tip part 433 formed with the external thread 431. The base end part 432 faces the base end side inner peripheral surface 61 of the collar 6, and the tip part 433 is a part to be engaged threadedly with the internal thread 53 of the nut 5. Note that the external thread 431 may be formed over the entire length of the tip portion 43 of the shaft. However, in this case, a groove for threading is formed at a base end position of the tip side shaft 43.

A tapered surface 422 linking the outer peripheral surface of the base portion 42 of the shaft and the outer peripheral surface of the tip portion 43 of the shaft is formed between the base portion 42 and the tip portion 43 of the bolt 4. A tip surface 413 of the head 41 of the bolt 4 in the axial direction L contact the base end surface 611 of the collar 6, whereas the tapered surface 422 of the bolt 4 does not contact the collar 6.

(Collar 6)

Figure 4:
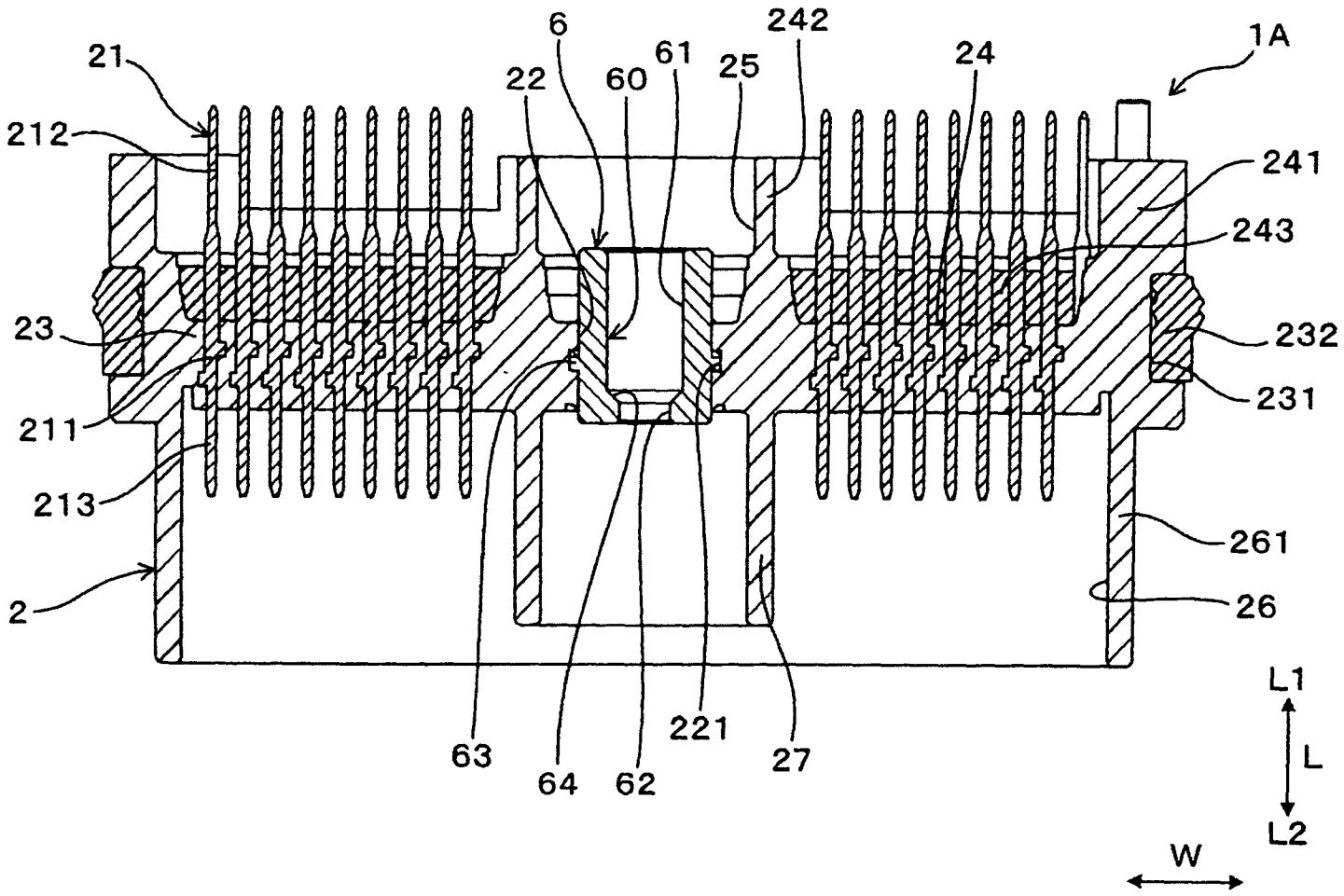
FIG. 4 is a front view in section of a first connector of the connector fitting body according to the embodiment.

As shown in FIGS. 2 and 4, the metal collar 6 has a hollow cylindrical shape and is embedded in the first housing 2 by insert molding. The first housing 2 and the collar 6 are formed by filling a resin material, which will constitute the first housing 2, into a mold having the collar 6 arranged therein. The collar 6 is arranged at a center position of the first housing 2 in the width direction W and the thickness direction B.

A center hole 60 is formed in a central part of the collar 6 and partially receives the base portion 42 and the tip portion 43 of the shaft of the bolt 4. The base end inner peripheral surface 61 is formed at the position of the base end side L1 in the axial direction L in the center hole 60 of the collar 6, and the tip side inner peripheral surface 62 is formed at the position of the tip side L2 in the axial direction L in the center hole 60 of the collar 6. The collar 6 is sandwiched between the head 41 of the bolt 4 and the nut 5 and transmits a force by metal components, i.e. from the head 41 of the bolt 4 to the nut 5.

As shown in FIGS. 2 and 4, a projection 63 *s* formed on the outer peripheral surface of the collar 6 for preventing the escape of the collar 6 from the first insertion hole 22 of the first housing 2 *i*. The projection 63 presses the first housing 2 to the second housing 3 when the collar 6 receives an axial force at the time of tightening. The projection 63 is formed over the entire periphery of the outer peripheral surface of the collar 6. A cross-sectional shape of the projection 63 cut in parallel to the axial direction L partially changes in a circumferential direction of the outer peripheral surface of the collar 6 and prevents rotation of the collar 6 with respect to the first housing 2.

A tapered inner peripheral surface 64 is formed between the base end inner peripheral surface 61 and the tip inner peripheral surface 62 of the collar 6 in the axial direction L and faces the tapered surface 422 of the bolt 4. The collar 6 may be arranged in the first insertion hole 22 of the first housing 2 after the first housing 2 is molded, besides being arranged in the first insertion hole 22 of the first housing 2 by insert molding. Note that another oil-proof sealing member for sealing a clearance between the outer peripheral surface of the collar 6 and the first insertion hole 22 also can be mounted on the outer peripheral surface of the collar 6.

As shown in FIG. 2, the tip inner peripheral surface 62 is shorter than the base end inner peripheral surface 61 in the axial direction L of the collar 6. Further, a clearance between the tip portion 43 of the shaft and the tip inner peripheral surface 62 is smaller than that between the base portion 42 of the shaft and the base end inner peripheral surface 61. The bolt 4 mainly is positioned with respect to the collar 6 in the direction perpendicular to the axial direction L by the tip portion 43 of the shaft and the tip inner peripheral surface 62.

The collar 6 can be formed by cold forging. However, the tip inner peripheral surface 62 can be formed by cutting a lower hole formed by forging to reduce a dimensional tolerance with the tip portion 43 of the bolt 4. In this case, an area where cutting is performed can be reduced since a length of the tip inner peripheral surface 62 in the axial direction L is shorter than that of the base end portion 42 of the shaft in the axial direction L. Dimensional tolerances between the bolt 4 and the collar 6 are adjusted easily adjusted.

(Nut 5)

As shown in FIGS. 2 and 5, the metal nut 5 is formed with the internal thread (screw hole) 53 to be engaged threadedly with the external thread 431 of the tip portion 43 of the bolt 4. The nut 5 is arranged in the second insertion hole 32 of the second housing 3, and the rotation thereof in tightening the bolt 4 is prevented. Note that the nut 5 can have various cross-sectional shapes besides polygonal shapes to prevent rotation with respect to the second insertion hole 32.

The nut 5 includes a step 52 for pressing the second housing 3 toward the first housing 2 when receiving an axial force by the tightening of the bolt 4. A general portion 51 of the nut 5 located on the base end L1 in the axial direction L has a circular cross-sectional shape, and the step 52 of the nut 5 located on the tip side L2 in the axial direction L has a polygonal cross-sectional shape. An outer cross-sectional shape of the step 52 perpendicular to the axial direction L is larger than that of the general portion 51 perpendicular to the axial direction L. The inner peripheral surface of the second insertion hole 32 of the second housing 3 has a cross-sectional shape in conformity with the cross-sectional shapes of the general portion 51 and the step 52.

The nut 5 is arranged in the second insertion hole 32 of the second housing 3 after the second housing 3 is molded, but may be arranged in the second housing 3 by insert-molding. The first insertion hole 22 of the first housing 2 and the second insertion hole 32 of the second housing 3 communicate in the connector fitting body 1.

(First Terminals 21)

As shown in FIGS. 1 and 4, the connector fitting body 1 is mounted on a printed board serving as the control board 8. The first terminals 21 are conductor pins made of a conductive material and serving as male terminals to be conductive with conductor portions provided on the control board 8. The first terminals 21 are inserted into through holes 81 formed in the control board 8 under the air environment R1 and electrically connected to the conductor portions of the control board 8 by soldering or the like.

Intermediate portions 211 of the first terminals 21 in the axial direction L are embedded in a facing portion 23 of the first housing 2 facing the second housing 3. Both end parts 212, 213 of the first terminals 21 project toward both sides from the facing portion 23 along the axial direction L. Base parts 212 of the first terminals 21 located on the base end L1 are connected to the control board 8. Tips 213 of the first terminals 21 located on the tip side L2 in the first housing 2 are connected to the respective second terminals 21 in the second housing 3.

The first terminals 21 are arranged side by side in the width direction W and the thickness direction B perpendicular to the axial direction L while being parallel to the axial direction L of the bolt 4 in the first housing 2. The first terminals 21 are arranged in a divided manner at both sides of the first insertion hole 22 in the width direction W.

(Second Terminals 31)

As shown in FIGS. 1 and 5, the second terminals 31 are arranged in the oil environment R2, and wires 311 wired in the electronic control equipment 72 are connected respectively to the respective second terminals 31. The second terminals 31 are made of a conductive material. The second terminals 31 are female terminals and are held in terminal holes 34 formed in the second housing 3.

The second terminals 31 are arranged side by side in the width direction W and the thickness direction B perpendicular to the axial direction L while being parallel to the axial direction L of the bolt 4 in the second housing 3. The second terminals 31 are arranged in a divided manner at both sides of the second insertion hole 32 in the width direction W.

(First Housing 2)

As shown in FIG. 4, the first housing 2 forms the first connector 1A serving as a male connector, and is formed by inserting the first terminals 21 and performing insert molding using a resin, such as a thermoplastic resin. The first housing 2 includes the facing portion 23 facing the second housing 3, arrangement recesses 24 formed on the base end side L1 of the facing portion 23 and having the base ends 212 of the first terminals 21 arranged therein. A head recess 25 is formed on the base end side L1 of the facing portion 23 and has the head 41 of the bolt 4 arranged therein. Fitting recesses 26 are formed on the tip side L2 of the facing portion 23 and have the second connector 1B (second housing 3) fit therein.

The first insertion hole 22 penetrate through the facing portion 23 in the axial direction L at the center position of the first housing 2 in the width direction W and the thickness direction B. A groove 221 extending along the projection 63 of the collar 6 is formed in the inner peripheral surface of the first insertion hole 22.

As shown in FIGS. 4 and 6, the arrangement recesses 24 are formed at both sides of the head recess 25 in the width direction W. The arrangement recesses 24 are enclosed by an outer wall 241 projecting toward the base end L1 from the entire periphery of an outer peripheral part of the facing portion 23 and partition walls 242 formed in the outer wall 241. The partition walls 242 at both sides of the head 41 of the bolt 4 in the width direction W, and the head recess 25 is formed between two of the partition walls 242.

A sealing resin 243 made of an adhesive, such as a thermosetting resin, is formed in a bottom part of the arrangement recess 24. The sealing resin 243 is formed in contact with the entire periphery of each first terminal 21. Even if oil penetrates into a clearance between each first terminal 21 and the first housing 2, the sealing resin 243 prevents penetration of this oil to the control board 8 along each first terminal 21.

The fitting recesses 26 are at both sides of the first insertion hole 22 in the width direction W. The fitting recesses 26 are enclosed by a side wall 261 projecting toward the tip side L2 from the entire periphery of the outer peripheral part of the facing portion 23. Further, ribs 27 to be inserted into the second housing 3 are formed at positions inside the side wall 261 and at both sides of the collar 6 in the width direction W in the first housing 2.

(Second Housing 3)

As shown in FIG. 5, the second housing 3 forms the second connector 1B serving as a female connector, and is formed by molding a resin, such as a thermoplastic resin. The second housing 3 is formed with insertion recesses 33 into which the ribs 27 of the first housing 2 are inserted. The insertion recess 33 is formed in conformity with the entire or partial shape of the rib 27 to guide the rib 27 in the axial direction L.

Further, as shown in FIG. 1, a bracket 36 is mounted on the second housing 3 for loosely movably mounting the connector fitting body 1 on the automatic transmission, serving as the machine component 7. The second housing 3 is formed with an engaging portion 35 to be engaged with the bracket 36 for loose movement. The connector fitting body 1 is supported on the automatic transmission by the bracket 36 for loose movement. In mounting the case 71 on the automatic transmission, the connector fitting body 1 loosely moves with respect to the automatic transmission so that the connector fitting body 1 easily can be arranged in the case hole 711 of the case 71.

(Assembling/Arranging Method of Connector Fitting Body 1)

Next, a case is described where the connector fitting body 1 is used as a relay connector. Assembly of the connector fitting body 1 is started by: preparing the first connector 1A with the first terminals 21 and the collar 6 in the first housing 2; preparing the second connector 1B with the second terminals 31 in the second housing 3; preparing the bolt 4 with the oil-proof sealing member 45 and the waterproof sealing member 44 mounted thereon; and providing the nut 5, as shown in FIGS. 3 to 5. Further, the wires 311 are connected to the respective second terminals 31 of the second connector 1B. Then, the bolt 4 is arranged in the center hole 60 of the collar 6 of the first connector 1A and the nut 5 is arranged in the second insertion hole 32 of the second connector 1B.

Figure 7:
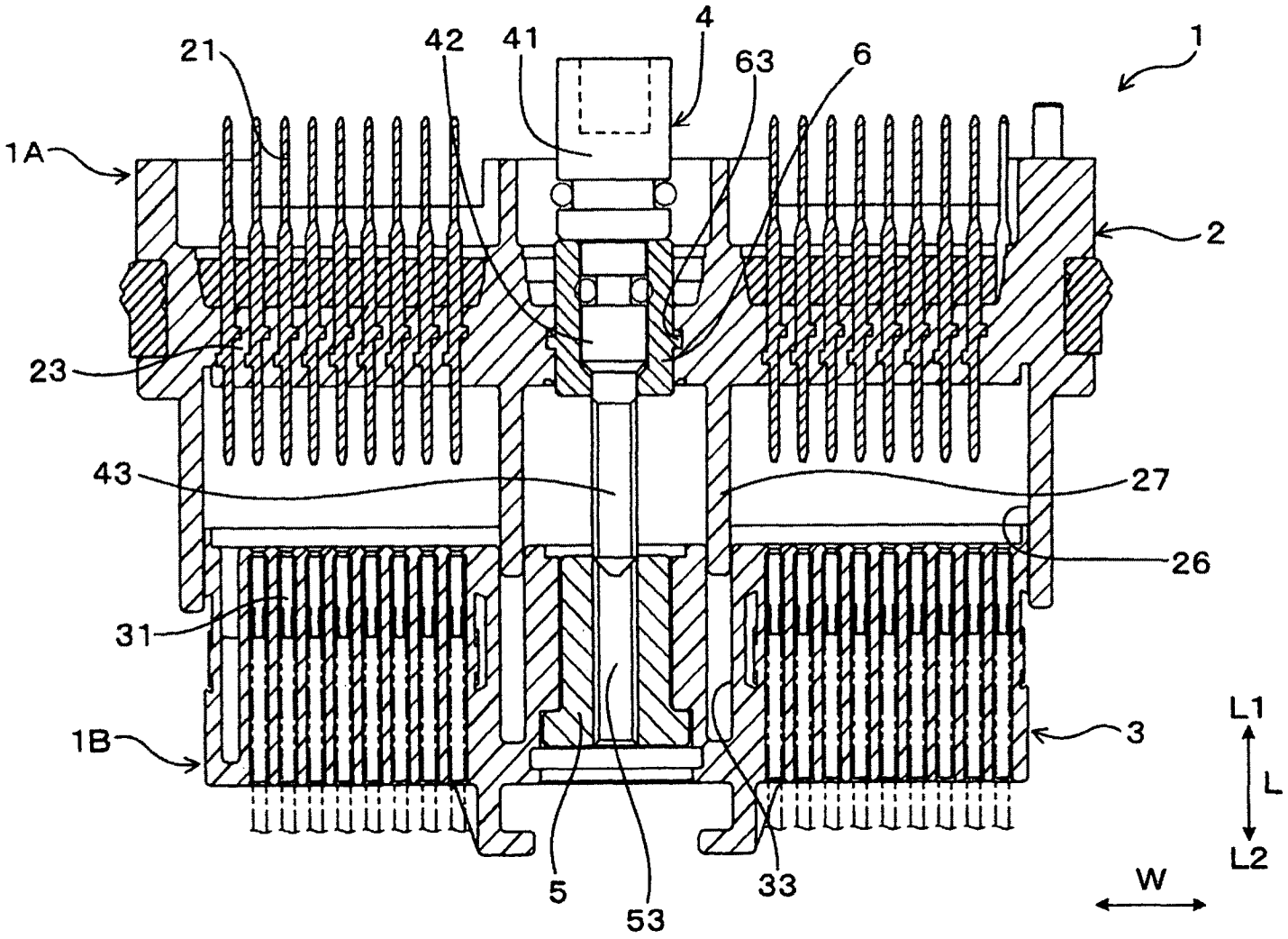
FIG. 7 is a front view in section showing a state where the first connector and the second connector according to the embodiment are fit to form the connector fitting body.

The first and second connectors 1A and 1B then are opposed to each other with the first and second terminals 21 and 31 are facing each other, as shown in FIG. 7. Then, the bolt 4 is rotated by the tool engaged with the tool engaging portion 412 of the head 41 and the external thread 431 of the tip portion 43 of the bolt 4 is engaged threadedly with the internal thread 53 of the nut 5. At this time, the head 41 of the bolt 4 pushes the first housing 2 toward the second housing 3 via the collar 6 according to the rotation of the bolt 4.

The first and second housings 2 and 3 then are sandwiched between the projection 63 of the collar 6 pushed by the bolt 4 and the step 52 of the nut 5 so that the first connector 1A approaches the second connector 1B and the respective first terminals 21 enter the respective second terminals 31. Then, the bolt 4 is tightened into the nut 5, and the tips 213 of the first terminals 21 connect to the respective second terminals 31. In this way, the connector fitting body 1 in which the first and second connectors 1A and 1B are fit is formed.

Subsequently, as shown in FIG. 1, the connector fitting body 1 is mounted on the automatic transmission serving as the machine component 7 by the bracket 36 mounted on the engaging portion 35 of the second connector 1B. In mounting the case 71 on the automatic transmission, the connector fitting body 1 can move loosely with respect to the automatic transmission by the bracket 36, and the connector fitting body 1 easily is arranged in the case hole 711 of the case 71.

Subsequently, the control board 8 is arranged on the first connector 1A of the connector fitting body 1. At this time, the base ends 212 of the respective first terminals 21 projecting toward the base end side L1 from the first connector 1A are inserted into the through holes 81 of the control board 8. Then, the base ends 212 of the respective first terminals 21 are joined to the conductor portions of the control board 8 by soldering or the like. Thereafter, the control board 8 is covered by the cover 82.

Function and Effects

In the connector fitting body 1 of this embodiment, the metal collar 6 is sandwiched between the head 41 of the bolt 4 and the nut 5 so that the first and second housings 2 and 3 are not compressed more than necessary. Further, the shape of the inner peripheral surface of the collar 6 is devised to make the bolt 4 less likely to incline with respect to the collar 6 and the first housing 2.

More specifically, the metal bolt 4 is formed with the head 41, the base portion 42 and the tip portion 43. The outer diameter of the base portion 42 of the shaft is smaller than that of the head 41 and the outer diameter of the tip portion 43 of the shaft is smaller than that of the base portion 42 of the shaft. The base portion 42 of the shaft of the bolt 4 is arranged on the base end inner peripheral surface 61 of the collar 6, and the tip portion 43 of the shaft of the bolt 4 is arranged on the tip inner peripheral surface 62 of the collar 6. That is, the inner peripheral shape of the collar 6 is changed in two steps in conformity with the outer peripheral shape of the bolt 4 whose outer diameter is changed in two steps.

The posture of the bolt 4 with respect to the collar 6 and the first housing 2 is supported mainly by the tip inner peripheral surface 62 of the collar 6 by supporting the tip portion 43 of the bolt 4 on the base end inner peripheral surface 61 of the collar 6. In this way, a position where the collar 6 supports the bolt 4 in the first housing 2 can be set near the center position of the bolt 4 in the axial direction L and maximally close to the second housing 3 having the nut 5 arranged therein. In this way, the bolt 4 can be made less likely to incline with respect to the collar 6 and the first housing 2, and the first housing 2 and the second housing 3 can be fit more easily by tightening the bolt 4 into the nut 5.

Further, the bolt 4 is arranged in the center hole 60 of the metal collar 6, dimensional tolerances of the tip inner peripheral surface 62 and the tip portion 43 of the bolt 4 can be adjusted more appropriately by adjusting the inner diameter of the tip inner peripheral surface 62 of the metal collar 6. Thus, dimensional tolerances between the bolt 4 and the collar 6 is made more easily and the bolt 4 is less likely to incline with respect to the collar 6 and the first housing 2.

A tightening force of the bolt 4 is received by the nut 5 via the metal collar 6. A positional relationship of the first and second housings 2 and 3 made of resin in the axial direction L is fixed by the joining of metal members, i.e. the bolt 4, the collar 6 and the nut 5. Thus, the first housing 2 and the second housing 3 are not compressed more than necessary, and a fit state of the first and second housings 2 and 3 is maintained.

Therefore, the bolt 4 is less likely to incline with respect to the collar 6 and the first housing 2 and the fit state of the first and second housings 2 and 3 is maintained.

The connector fitting body 1 of the invention is not limited only to the embodiment and can constitute different embodiments without departing from the gist thereof. Further, the invention includes various modifications, modifications within the scope of equivalents and the like. Furthermore, combinations, forms and the like of various constituent elements envisaged from the invention are also included in the technical concept of the present invention.

LIST OF REFERENCE SIGNS

1 connector fitting body
1A first connector
1B second connector
2 first housing
21 first terminal
22 first insertion hole
3 second housing
31 second terminal
32 second insertion hole
4 bolt
41 head
42 base portion of shaft
43 tip portion of shaft
431 external thread
44 waterproof sealing member
45 oil-proof sealing member
5 nut
51 general portion
52 step
53 internal thread
6 collar
61 base end inner peripheral surface
62 tip inner peripheral surface
63 projection

What is claimed is:

1. A connector fitting body, comprising:

a first housing having first terminals held therein:

a second housing having second terminals held therein and to be fit to the first housing, the second terminals being respectively held in contact with the first terminals to be conductive with the first terminals;

a metal collar arranged in a first insertion hole of the first housing;

a metal nut arranged in a second insertion hole of the second housing; and a metal bolt including a head and a shaft with a base portion and a tip portion, the head being held in contact with a base end surface of the collar, the base portion of the shaft being linked coaxially to a tip side of the head, having a smaller outer diameter than the head and being arranged on an inner peripheral side of the collar, the tip portion of the shaft being linked coaxially to an end of the base portion of the shaft remote from the head, having a smaller outer diameter than the base portion of the shaft, being partially arranged in the collar and formed with an external thread to be engaged threadedly with an internal thread of the nut;

an inner peripheral surface of the collar being formed with a base end inner peripheral surface having the base portion of the shaft arranged thereon and a tip inner peripheral surface having a smaller inner diameter than the base inner peripheral surface and having the tip portion of the shaft arranged thereon.

2. The connector fitting body of claim 1, wherein a clearance between the tip portion of the shaft and the tip inner peripheral surface is smaller than a clearance between the base portion of the shaft and the base inner peripheral surface.

3. The connector fitting body of claim 1, wherein:

the collar is embedded in the first housing by insert molding; and a projection for preventing detachment of the collar from the first insertion hole of the first housing is formed on an outer periphery of the collar.

4. The connector fitting body of claim 1, wherein the nut includes a step for pressing the second housing toward the first housing.

5. The connector fitting body of claim 1, wherein:

the first terminals are exposed in an air environment in which a control board is arranged;

the second terminals are exposed in an oil environment; and an oil-proof sealing member for sealing a clearance between the base portion and the base end inner peripheral surface is mounted on an outer peripheral surface of the base portion of the shaft.

6. The connector fitting body of claim 1, wherein:

the first terminals are conductor pins to be conductive with conductor portions provided on a control board; and a waterproof sealing member for sealing a clearance between the head and a through hole formed in a cover covering the control board is mounted on an outer peripheral surface of the head.

* * * * *